US011186298B2

(12) United States Patent
Li et al.

(10) Patent No.: US 11,186,298 B2
(45) Date of Patent: Nov. 30, 2021

(54) TRAIN WINDOW STRUCTURE AND TRAIN WITH TRAIN WINDOW STRUCTURE

(71) Applicant: CRRC Qingdao Sifang Co., Ltd., Shandong (CN)

(72) Inventors: Hong Li, Shandong (CN); Kainan Mao, Shandong (CN); Yali Jia, Shandong (CN); Yu Zeng, Shandong (CN); Shanshan Wang, Shandong (CN); Peng Gao, Shandong (CN)

(73) Assignee: CRRC QINGDAO SIFANG CO., LTD., Shandong (CN)

( * ) Notice: Subject to any disclaimer, the term of this patent is extended or adjusted under 35 U.S.C. 154(b) by 399 days.

(21) Appl. No.: 16/325,671

(22) PCT Filed: Sep. 30, 2017

(86) PCT No.: PCT/CN2017/104843
§ 371 (c)(1),
(2) Date: Feb. 14, 2019

(87) PCT Pub. No.: WO2018/082426
PCT Pub. Date: May 11, 2018

(65) Prior Publication Data

US 2019/0202483 A1 Jul. 4, 2019

(30) Foreign Application Priority Data

Nov. 3, 2016 (CN) ..... 201610958227.6
Nov. 4, 2016 (CN) ..... 201610972896.9

(51) Int. Cl.
*B61D 25/00* (2006.01)
*B61D 17/02* (2006.01)

(52) U.S. Cl.
CPC ..... *B61D 25/00* (2013.01); *B61D 17/02* (2013.01)

(58) Field of Classification Search
CPC .. B61D 25/00; B61D 17/02; B60J 1/10; B60J 1/02; B60J 1/08; B60J 1/18; B60J 1/1838;
(Continued)

(56) References Cited

U.S. PATENT DOCUMENTS 6,010,180 A * 1/2000 Bureau ..... E05D 1/06 296/146.16
2011/0042516 A1* 2/2011 Dolzinski ..... B64C 1/1492 244/129.3

FOREIGN PATENT DOCUMENTS

CN 2753858 Y 1/2006
CN 201170023 Y 12/2008
(Continued)

OTHER PUBLICATIONS

DE 299 15 261 (English translation) (Year: 1999).*
(Continued)

*Primary Examiner* — Mark T Le
(74) *Attorney, Agent, or Firm* — Cantor Colburn LLP

(57) ABSTRACT

A train window structure and a train with the train window structure, the train window structure comprising: a train window frame; train window glass disposed in the train window frame; and a fastener penetrating through an inner side of the train window frame and disposed on a train body to fasten the train window frame, the axis of the fastener being parallel to a plane where the train window glass is provided. The fastener penetrates through the train window frame from an inner side of the train window frame and is screwed into the train body; the fastener is internally installed, thus reducing a gap between the adjacent train window structures, so that the train body is more aesthetically pleasing and wind resistance is lower.

13 Claims, 3 Drawing Sheets

(58) Field of Classification Search
CPC . B60J 1/1846; B60J 1/007; E06B 1/56; E06B 1/60; E06B 1/6015
See application file for complete search history.

(56) References Cited

FOREIGN PATENT DOCUMENTS

| | | | |
|---|---|---|---|
| CN | 202038314 | U | 11/2011 |
| CN | 202047711 | U | 11/2011 |
| CN | 202106981 | U | 1/2012 |
| CN | 202131940 | U | 2/2012 |
| CN | 102678024 | A | 9/2012 |
| CN | 20262424 | U | 12/2012 |
| CN | 202703594 | U | 1/2013 |
| CN | 202788433 | U | 3/2013 |
| CN | 202935355 | U | 5/2013 |
| CN | 202952994 | U | 5/2013 |
| CN | 204199956 | U | 3/2015 |
| CN | 104494624 | A | 4/2015 |
| CN | 105922999 | A | 9/2016 |
| CN | 105966414 | A | 9/2016 |
| CN | 106347392 | A | 1/2017 |
| CN | 106379353 | A | 2/2017 |
| CN | 206217897 | U | 6/2017 |
| DE | 299 15 261 | * | 11/1999 |
| DE | 20113220 | U1 | 12/2001 |
| DE | 19858491 | C2 | 3/2002 |
| EP | 0233143 | A1 | 1/1987 |
| EP | 0895890 | A1 | 2/1999 |
| JP | 6432212 | U | 2/1989 |
| JP | 6312660 | A | 11/1994 |
| JP | 8207762 | A | 8/1996 |

OTHER PUBLICATIONS

International Search Report and Written Opinion received for PCT Patent Application No. PCT/CN2017/104843, dated Jan. 2, 2018, 12 pages (3 Pages of English Translation and 9 Pages of Original Document).

European Search Report for corresponding application EP 17 86 7541; Report dated Mar. 2, 2020.

* cited by examiner

TRAIN WINDOW STRUCTURE AND TRAIN WITH TRAIN WINDOW STRUCTURE

CROSS-REFERENCE TO RELATED APPLICATIONS

This application is a national phase entry under 35 U.S.C. § 371 of International Patent Application PCT/CN2017/104843, filed Sep. 30, 2017, designating the United States of America and published in Chinese as International Patent Publication WO 2018/082426 A1 on May 11, 2018, which claims the benefit under Article 8 of the Patent Cooperation Treaty to Chinese Patent Application Serial No. 201610958227.6 filed Nov. 3, 2016 and Chinese Patent Application Serial No. 201610972896.9 filed Nov. 4, 2016, the disclosure of each of which is hereby incorporated herein in its entirety by this reference.

TECHNICAL FIELD

The disclosure relates to a technical field of locomotives, and particularly relates to a train window structure and a train with the train window structure.

BACKGROUND

With the continuous development of society, appearance requirements of a user to a rail vehicle are higher and higher. According to an existing clear-blind combined window of the rail vehicle, both a clear window part and a blind window part adopt a mode of externally fixing by using a sunk screw. Because an external space is occupied by the sunk screw, an inaesthetic problem caused by a larger peripheral glue line (14-17 mm) exists in the traditional combined window generally, and the quality of a train is seriously affected so as to cause strong dissatisfaction of the user.

BRIEF SUMMARY

In some embodiments, the disclosure may provide a train window structure and a train with the train window structure, and solve a problem in the conventional art that a sealing gap of a train window is large.

In order to achieve the above purpose, according to one aspect of the disclosure, a train window structure is provided, the train window structure including a train window frame, train window glass disposed in the train window frame, and a fastener penetrating through the train window frame from an inner side of the train window frame and disposed on a train body so as to fasten the train window frame, an axis of the fastener being parallel to a plane where the train window glass is provided.

In an exemplary embodiment, the train window frame includes a train window frame body, an inner side of the train window frame body is provided with an installing groove, and a bottom of the installing groove is provided with an installing hole.

In an exemplary embodiment, the train window frame further includes a window frame edgefold, a first end of the window frame edgefold is connected with the train window frame body and a first included angle is formed between the window frame edgefold and the train window frame body, a second end of the window frame edgefold is provided away from the train window frame body, and the fastener penetrates through the window frame edgefold.

In an exemplary embodiment, the window frame edgefold is perpendicular to the train window frame body.

In an exemplary embodiment, the train window frame further includes: a first stopping convex rib, one end of the first stopping convex rib is connected with the window frame edgefold and a second included angle is formed between the first stopping convex rib and the window frame edgefold, the other end of the first stopping convex rib is provided away from the train body, and the fastener is positioned at an inner side of the first stopping convex rib; and a second stopping convex rib, the second stopping convex rib is provided on the window frame edgefold, the second stopping convex rib and the first stopping convex rib are positioned at a same side of the window frame edgefold, the installing groove is formed among the second stopping convex rib, the first stopping convex rib and the window frame edgefold, and the fastener is positioned in the installing groove.

In an exemplary embodiment, an end part of the first stopping convex rib is provided with a first flange and a second flange, a locking slot is formed between the first flange and the train window frame body, and the second flange extends toward the second stopping convex rib.

In an exemplary embodiment, the end part of the second stopping convex rib is provided with a third flange, and the third flange extends toward the first stopping convex rib.

In an exemplary embodiment, the installing hole is provided in the window frame edgefold.

In an exemplary embodiment, the train window frame includes a sealant tape, the sealant tape is locked in the installing groove and positioned at an outer side of the fastener.

In an exemplary embodiment, a hollow structure is formed between the sealant tape and the bottom of the installing groove.

In an exemplary embodiment, the train window frame structure is made of a carbon fiber material.

In an exemplary embodiment, the sealant tape includes a sealant tape body locked in the installing groove, and a first sealing flange, one end of the first sealing flange is connected with the sealant tape body, and the other end of the first sealing flange is fit with the train window glass.

In an exemplary embodiment, the sealant tape includes a second sealing flange, one end of the second sealing flange is connected with the sealant tape body, and the other end of the second sealing flange extends toward an opposite direction of an extending direction of a second end of the first sealing flange.

In an exemplary embodiment, the window frame edgefold is an annular structure.

In an exemplary embodiment, the fastener is a bolt.

According to another aspect of the disclosure, a train is provided, and the train includes the above train window structure.

In an exemplary embodiment, the train includes a train body, the train body is provided with a clear window installing part and a blind window installing part; and clear window glass and blind window glass, the clear window glass is installed on the clear window installing part through the train window frame, and the blind window glass is adhered to the blind window installing part.

By applying the technical scheme of the disclosure, while the train window structure of the disclosure is installed, because the fastener penetrates through the train window frame from the inner side of the train window frame and is screwed into the train body, through internally installing the fastener, a gap between the neighboring train window structures is reduced, so that the train body is more aesthetically pleasing and wind resistance is lower.

BRIEF DESCRIPTION OF THE DRAWINGS

The accompanying drawings, which constitute a part of this application, are used to provide a further understanding of the disclosure, and the exemplary embodiments of the disclosure and the description thereof are used to explain the disclosure, but do not constitute improper limitations to the disclosure. In the drawings.

Figure 1:
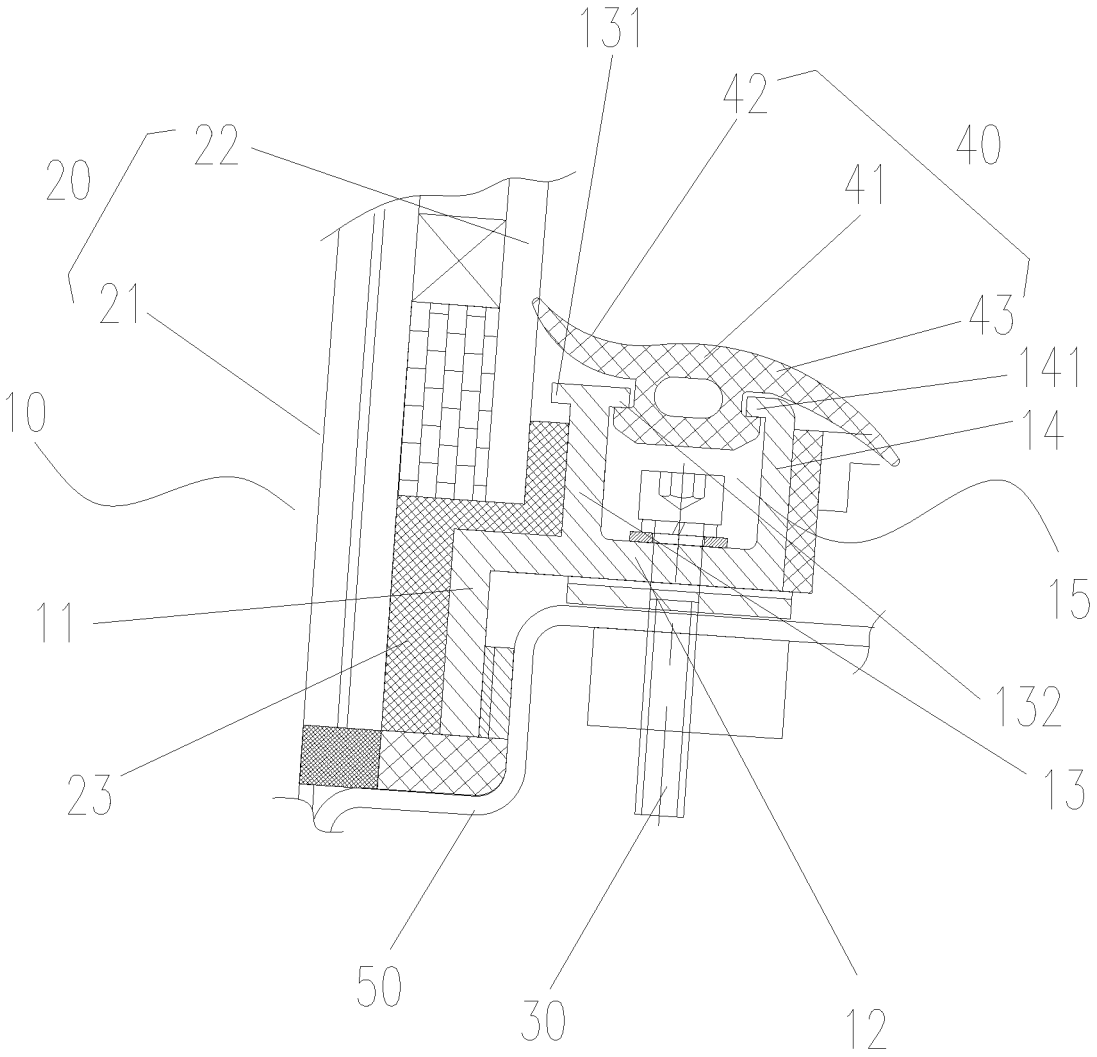
FIG. 1 schematically shows a cross-sectional view of an embodiment of the train window structure of the disclosure.

Herein, the above drawings include the following drawing reference numerals:

10: train window frame; 11: train window frame body; 12: window frame edgefold; 13: first stopping convex rib; 131: first flange; 132: second flange; 14 second stopping convex rib; 141: third flange; 15: installing groove; 16: installing hole; 20: train window glass; 21: outer layer glass; 22: inner layer glass; 23: sealing glue cushion; 30: fastener; 40: sealant tape; 41: sealant tape body; 42: first sealing flange; 43: second sealing flange; 50: train body; 60: train body window; 61: blind window glass; 62: blind window frame; 63: glue line; 64: adjusting glue sheet; 65: built-in wallboard.

DETAILED DESCRIPTION

It is to be noted that embodiments in the application and features in the embodiments may be mutually combined in the case without conflicting. The disclosure is explained in detail with reference to the drawings in combination with the embodiments below.

It is to be understood that terms used herein only aim to describe specific implementation manners, and are not intended to limit exemplary implementations of the application. Unless otherwise directed by the context, singular forms of terms used herein are intended to include plural forms. In addition, it is to be further understood that when terms "contain" and/or "include" are used in the description, it is indicated that features, steps, operations, devices, assemblies and/or a combination thereof exist.

It is to be noted that in the specification and claims of the disclosure, the terms "first," "second," and the like in the drawings are intended to distinguish similar objects, and are not necessarily to describe a specific sequence or a precedence order. It is to be understood that terms used in such a way may be exchanged under appropriate conditions, so that the embodiments of the disclosure described herein can be implemented in a sequence other than the sequences graphically shown or described herein. In addition, the terms "comprise," "include," and variations thereof, are intended to cover non-exclusive inclusions. For example, processes, methods, systems, products or devices containing a series of steps or units do not need to clearly show those steps or units, and may include other inherent steps or units of these processes, methods, products or devices, which are not clearly shown.

For ease of description, spatial relative terms such as "over," "above," "on an upper surface" and "upper" may be used herein for describing a spatial position relation between a device or feature and other devices or features shown in the drawings. It is to be understood that the spatial relative terms aim to contain different orientations in usage or operation other than the orientations of the devices described in the drawings. For example, if the devices in the drawings are inverted, devices described as "above other devices or structures" or "over other devices or structures" will be located as "below other devices or structures" or "under other devices or structures." Thus, an exemplary term "above" may include two orientations, namely, "above" and "below." The device may be located in other different modes (rotated by 90 degrees or located in other orientations), and spatial relative descriptions used herein are correspondingly explained.

Now, the exemplary embodiments according to the disclosure will be described in detail with reference to the drawings. However, the exemplary embodiments may be implemented in multiple different modes, and are not intended to be limited by the described implementation modes herein. It is to be understood that the implementation modes are provided so that the disclosure is completely and totally disclosed, and the conceptions of the example implementation modes are adequately transmitted to those of ordinary skill in the art, in the drawings, for clarity, the thicknesses of layers and areas may be enlarged, and the same reference numeral is used for representing the same device, so that their description is omitted.

Figure 2:
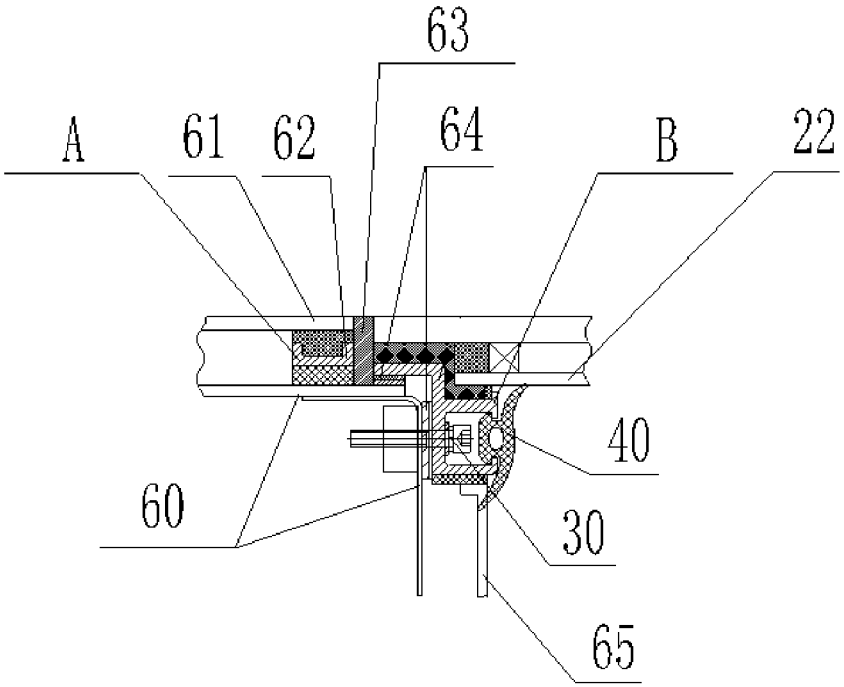
FIG. 2 schematically shows a cross-sectional view of an embodiment of a blind train window frame and a clear train window of the train window structure of the disclosure.
Figure 3:
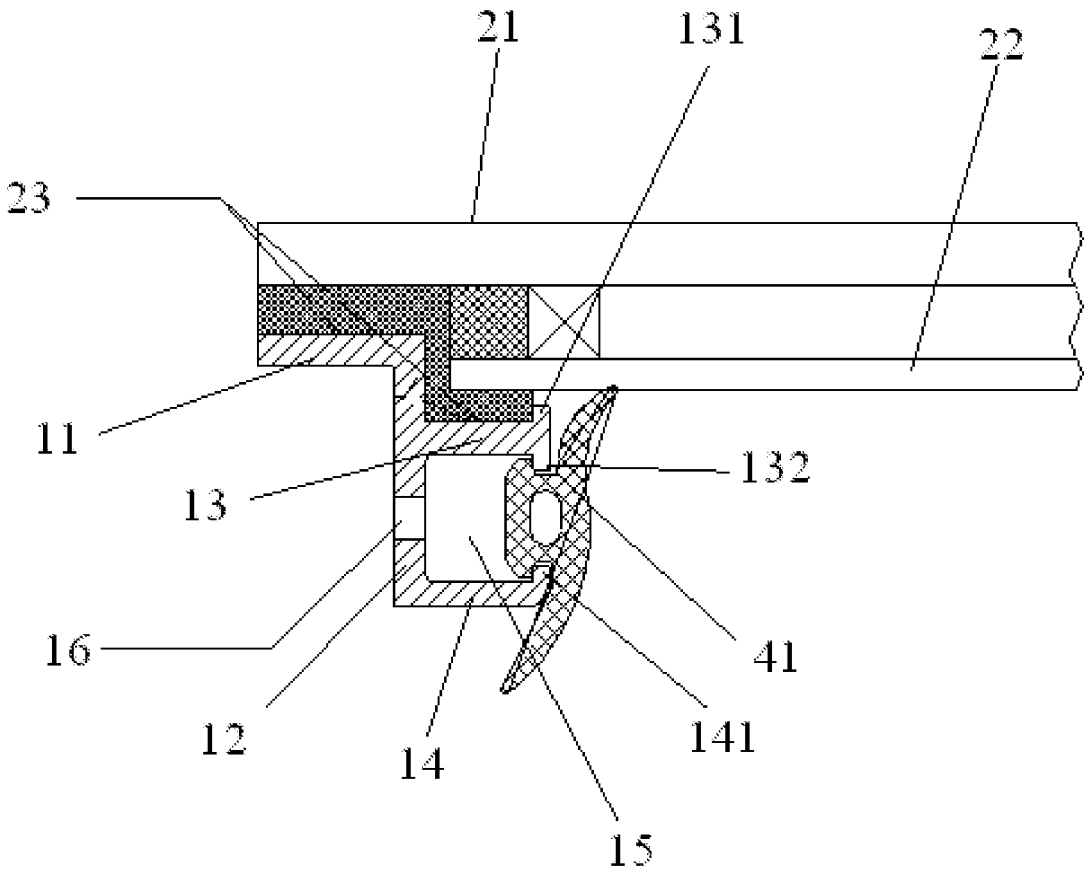
FIG. 3 schematically shows a cross-sectional structure diagram of the train window structure without installing a fastener of the disclosure.

As mentioned in the background, according to an existing clear-blind combined window of the rail vehicle, both a clear window part and a blind window part adopt a mode of externally fixing by using a sunk screw. Because an external space is occupied by the sunk screw, an inaesthetic problem caused by a larger peripheral glue line (14-17 mm) exists in the traditional combined window generally and, in a running process of the rail vehicle, because the glue line is larger, a wind resistance is generated so as to cause a noise. In order to solve the problem, as shown in FIG. 1 to FIG. 3, according to one aspect of the disclosure, a train window structure is provided. The train window structure includes a train window frame 10, train window glass 20 and a fastener 30, the train window glass 20 is arranged in the train window frame 10, the fastener 30 penetrates through from the inner side of the train window frame 10 and is disposed on a train body so as to fasten the train window frame 10, the axis of the fastener 30 is parallel to a plane where the train window glass 20 is provided. While the train window structure of the disclosure is installed, because the fastener 30 penetrates through the train window frame 10 from the inner side of the train window frame 10 and is screwed into the train body, the fastener 30 is internally installed; thus, a gap between the adjacent train window structures is reduced, so that the train body is more aesthetically pleasing and wind resistance is lower.

Specifically, the train window frame in the disclosure includes a train window frame body 11, the inner side of the train window frame body 11 is provided with an installing groove 15, and the bottom of the installing groove 15 is provided with an installing hole 16.

In the embodiment, through installing the fastener, such as a bolt, in the installing groove 15, the train window frame is fixed on the train body, a sealing gap between the train window frame and the train body is effectively reduced.

The train window frame further includes a window frame edgefold 12, a first end of the window frame edgefold 12 is connected with the train window frame body 11 and a first included angle is formed between the window frame edgefold 12 and the train window frame body 11. A second end of the window frame edgefold 12 is installed away from the train window frame body 11, the fastener 30 penetrates through the window frame edgefold 12. In an installing process, a worker enables the fastener 30 to penetrate through the train window frame 10 from the end surface, adjacent to the inner side of the train window frame 10, of the window frame edgefold 12 and to be screwed into the train body. Such installation is capable of enabling the train window frame to be fixed through the window frame edgefold 12, the installing efficiency and reliability of the train window frame are effectively improved.

In order to conveniently screw the fastener 30, the installing difficulty of the train window frame is reduced and the installing stability of the train window frame is increased. In some embodiments, the window frame edgefold 12 in the disclosure is perpendicular to the train window frame body 11, so the window frame edgefold 12 is installed tightly adjacent to the train body. A gap is prevented from existing between the window frame edgefold 12 and the train body so that the instability of the train window frame is reduced. Certainly, other angles may exist between the window frame edgefold 12 in the disclosure and the train window frame body 11, and all of the other angles that only satisfy a condition of conveniently screwing the fastener 30 fall within a scope of protection of the disclosure.

In order to provide an installing space to the fastener in the disclosure, and prevent external impurities from corroding the fastener, in some embodiments, the train window frame in the disclosure further includes a first stopping convex rib 13 and a second stopping convex rib 14, one end of the first stopping convex rib 13 being connected with the window frame edgefold 12 and a second included angle is formed between the first stopping convex rib 13 and the window frame edgefold 12. The other end of the first stopping convex rib 13 is installed away from the train body, and the fastener 30 is positioned at the inner side of the first stopping convex rib 13. In a working process, the impurities from the outer side of the first stopping convex rib 13 are stopped through the first stopping convex rib 13, thus protecting the fastener 30.

In order to provide the installing space to the fastener in the disclosure and further prevent the external impurities from corroding the fastener, in some embodiments, the train window frame in the disclosure further includes a second stopping convex rib 14. The second stopping convex rib 14 is installed on the window frame edgefold 12. The second stopping convex rib 14 and the first stopping convex rib 13 are positioned at the same side of the window frame edgefold 12. An installing groove 15 is formed between the second stopping convex rib 14 and the first stopping convex rib 13, and the fastener 30 is positioned in the installing groove 15. In the installing process, the worker enables the fastener 30 to penetrate through the installing groove, and to be screwed in the window frame edgefold 12. The fastener 30 is sealed through the installing groove, thus preventing external corrosion to the fastener 30. Such installation is capable of effectively increasing a side edge depth of the installing groove 15, so that the fastener or the bolt installed in the installing groove 15 may not protrude out of the installing groove 15.

The end part of the first stopping convex rib 13 is provided with a first flange 131 and a second flange 132. A locking slot is formed between the first flange 131 and the train window frame body 11, and the second flange 132 extends toward the second stopping convex rib 14. Through such installation, while the train window glass 20 is installed in the train window frame, the sealant tape 40 between the train window frame and the train window glass 20 may be locked in the locking slot better and does not fall off.

Further, the end part of the second stopping convex rib 14 is provided with a third flange 141, the third flange 141 extending toward the first stopping convex rib 13. The third flange 141 mutually cooperates with the second flange 132 so that the bottom cross-section of the installing groove 15 is greater than the cross-section of an opening of the installing groove 15. Through such installation, a locked object in the installing groove 15 may not easily fall off from the installing groove 15.

In some embodiments, an installing hole 16 is installed in the window frame edgefold 12. Such installation is capable of shortening a connecting distance between the needed fastener or bolt and the train body, increasing a connecting length of the bolt or the fastener and the train body, further enhancing the stability of the train window frame installed in the train body.

In order to further prevent the fastener from being corroded, in some embodiments, the train window structure in the disclosure further includes a sealant tape 40, the sealant tape 40 is locked in the installing groove 15 and positioned at the outer side of the fastener 30. In the installing process, the sealant tape 40 in the application is locked in the installing groove 15, and covers the opening of the installing groove 15 to form a sealed space, separating the fastener from the outside, further preventing the outside environment from affecting the work and service life of the fastener.

In order to avoid the end part of the fastener installed in the installing groove 15 from contacting the sealant tape 40 and causing an irregular convex point to be formed at the outer side of the sealant tape 40, thereby affecting the evenness of the sealant tape 40, a hollow structure is formed between the sealant tape 40 and the bottom of the installing groove 15.

In order to reduce the weight of the whole train body, and enable the train body to reach a lightweight standard, the train window frame is made of a carbon fiber material.

Specifically, the train window glass 20 in the disclosure includes outer layer glass 21 and inner layer glass 22, thereby forming a cavity between the inner layer glass 22 and the outer layer glass 21. In order to prevent the external impurities from entering the cavity between the outer layer glass 21 and the inner layer glass 22, the sealant tape 40 in the disclosure includes a sealant tape body 41 and a first sealing flange 42. The sealant tape body 41 is locked in the installing groove 15, with one end of the first sealing flange 42 is connected with the sealant tape body 41, and the other end of the first sealing flange 42 is fit with the train window glass 20. In the working process, while the sealed space is formed between the sealant tape 40 and the installing groove 15 in the disclosure, the cavity between the outer layer glass 21 and the inner layer glass 22 is sealed. The first sealing flange 42 is abutted against the inner layer glass 22, and the external impurities are mainly stopped through the first sealing flange 42. In some embodiments, the sealant tape 40 in the disclosure is a sealing rubber strip, while the first sealing flange 42 abuts against the inner layer glass 22, the first sealing flange 42 is bent toward a direction away from a frame of the inner layer glass 22, so the first sealing flange 42 is guaranteed to always have contact with the inner layer glass.

In order to position the inner layer glass 22 and the outer layer glass 21 while the inner layer glass 22 and the outer layer glass 21 are installed, the disclosure further includes a sealing glue cushion 23. In the working process, the inner layer glass 22 and the outer layer glass 21 are positioned through the sealing glue cushion 23.

In order to prevent the external impurities from entering the gap between the train body and the train window frame, the sealant tape 40 in the disclosure includes a second sealing flange 43, one end of the second sealing flange 43 being connected with the sealant tape body 41, and the other end of the second sealing flange 43 extending toward an opposite direction of an extending direction of the second end of the first sealing flange 42. The gap between the train window frame and the train body is covered by the second sealing flange 43 in order to stop the external impurities.

In order to reduce a gap between other windows and at four sides of the train window structure of the disclosure, in some embodiments, the window frame edgefold 12 in the disclosure is an annular structure. In the working process, multiple fasteners penetrate through the train window frame from the inner side of the train window frame at the four sides of the train window frame and are screwed into the train body. Certainly, the window frame edgefold 12 in the disclosure may be a linear type. Through the linear-type window frame edgefold 12, a gap between one side of the frame and the other windows is reduced. The window frame edgefold 12 in the disclosure may be set as other shapes according to other needs.

In some embodiments, the fastener 30 in the disclosure is a bolt, although other devices capable of satisfying the working requirements of the fastener in the disclosure may be utilized as well.

According to another aspect of the disclosure, a train is provided. The train includes the above train window structure. The train of the disclosure includes a train body 50, clear window glass and blind window glass. The train body 50 is provided with a clear window installing part and a blind window installing part. The clear window glass is installed on the clear window installing part through the train window frame 10, and the blind window glass is adhered to the blind window installing part. The train of the disclosure is capable of, through alternating installation of a clear window and a dark window, enabling the surface of the train to be smoother. A gap between the clear window and the dark window is reduced through the disclosed train window structure, making the appearance more beautiful, while reducing wind resistance.

As shown in FIG. 2, schematic diagrams of a blind window part (indicated as A in the figure) and a clear window part (referenced as B in the figure) in a train body window 60 and a train body built-in wallboard 65, the blind window glass 61 (single-layer glass or a polycarbonate plate) is installed in a blind window frame 62 of the train body through a mode of gluing. A glue line 63 exists between the clear window glass and the blind window glass, and an adjusting glue sheet 64 is installed in a clear window installing place, and is used for adjusting an installing position of the clear window frame.

The above are only example embodiments of the disclosure, and are not intended to limit the disclosure. As will occur to those skilled in the art, the disclosure is susceptible to various modifications and changes. Any modifications, equivalent replacements, improvements and the like made within the spirit and principle of the disclosure shall fall within the scope of protection of the disclosure.

What is claimed is:

1. A train window structure, comprising:

a train window frame (10);

train window glass (20), arranged on the train window frame (10); and a fastener (30), wherein the fastener (30) penetrates through the train window frame (10) from an inner side of the train window frame (10) and is arranged on a train body (50) so as to fasten the train window frame (10), and an axis of the fastener (30) is parallel to a plane where the train window glass (20) is provided;

wherein the train window frame (10) comprises:

a train window frame body (11), wherein an inner side of the train window frame body (11) is provided with an installing groove (15), and a bottom of the installing groove (15) is provided with an installing hole (16);

a window frame edgefold (12), wherein a first end of the window frame edgefold (12) is connected with the train window frame body (11) and a first included angle is formed between the window frame edgefold (12) and the train window frame body (11), a second end of the window frame edgefold (12) is provided away from the train window frame body (11), and the fastener (30) penetrates through the window frame edgefold (12);

wherein the train window frame (10) further comprises:

a first stopping convex rib (13), wherein one end of the first stopping convex rib (13) is connected with the window frame edgefold (12) and a second included angle is formed between the first stopping convex rib (13) and the window frame edgefold (12), the other end of the first stopping convex rib (13) is provided away from the train body (50), and the fastener (30) is positioned at an inner side of the first stopping convex rib (13); and a second stopping convex rib (14), wherein the second stopping convex rib (14) is provided on the window frame edgefold (12), the second stopping convex rib (14) and the first stopping convex rib (13) are positioned at a same side of the window frame edgefold (12), the installing groove (15) is formed among the second stopping convex rib (14), the first stopping convex rib (13) and the window frame edgefold (12), and the fastener (30) is positioned in the installing groove (15);

wherein an end part of the first stopping convex rib (13) is provided with a first flange (131) and a second flange (132), a locking slot is formed between the first flange (131) and the train window frame body (11), and the second flange (132) extends towards the second stopping convex rib (14).

2. The train window structure as claimed in claim 1, wherein the window frame edgefold (12) is perpendicular to the train window frame body (11).

3. The train window structure as claimed in claim 1, wherein an end part of the second stopping convex rib (14) is provided with a third flange (141), the third flange (141) extends towards the first stopping convex rib (13).

4. The train window structure as claimed in claim 1, wherein the installing hole (16) is provided in the window frame edgefold (12).

5. The train window structure as claimed in claim 1, wherein the train window frame (10) further comprises:

a sealant tape (40), wherein the sealant tape (40) is locked in the installing groove (15) and positioned at an outer side of the fastener (30).

6. The train window structure as claimed in claim 5, wherein a hollow structure is formed between the sealant tape (40) and the bottom of the installing groove (15).

7. The train window structure as claimed in claim 1, wherein the train window frame (10) structure is made of a carbon fiber material.

8. The train window structure as claimed in claim 5, wherein the sealant tape (40) comprises:

a sealant tape body (41), locked in the installing groove (15); and a first sealing flange (42), wherein one end of the first sealing flange (42) is connected with the sealant tape body (41), and the other end of the first sealing flange (42) is fit with the train window glass (20).

9. The train window structure as claimed in claim 8, wherein the sealant tape (40) comprises:

a second sealing flange (43), wherein one end of the second sealing flange (43) is connected with the sealant tape body (41), and the other end of the second sealing flange (43) extends towards an opposite direction of an extending direction of an second end of the first sealing flange (42).

10. The train window structure as claimed in claim 1, wherein the window frame edgefold (12) is an annular structure.

11. The train window structure as claimed in claim 1, wherein the fastener (30) is a bolt.

12. A train, comprising a train window structure, wherein the train window structure is the train window structure as claimed in claim 1.

13. The train as claimed in claim 12, wherein the train comprises:

a train body (50), wherein the train body (50) is provided with a clear window installing part and a blind window installing part; and clear window glass and blind window glass, wherein the clear window glass is installed on the clear window installing part through the train window frame (10), and the blind window glass is adhered to the blind window installing part.

* * * * *